US006164167A

United States Patent [19]

Chen

[11] Patent Number: 6,164,167

[45] Date of Patent: Dec. 26, 2000

[54] RATCHET WRENCH HAVING GEAR DRIVEN PAWL

[76] Inventor: Yu-Tang Chen, No. 111, Lane 699, Kuang Hsing Road, Taipin City, Taichung Hsien, Taiwan

[21] Appl. No.: 09/100,859

[22] Filed: Jun. 22, 1998

[51] Int. Cl.[7] ..... B25B 13/46

[52] U.S. Cl. ..... 81/63.2; 81/63

[58] Field of Search ..... 81/60, 61, 62, 81/63, 63.1, 63.2

[56] References Cited

U.S. PATENT DOCUMENTS

| | | | |
|---|---|---|---|
| 3,265,171 | 8/1966 | Kilness | 81/63 |
| 3,958,470 | 5/1976 | Lee | 81/63 |
| 5,178,047 | 1/1993 | Arnold et al. | 81/63.2 |
| 5,230,262 | 7/1993 | Ahlund et al. | 81/63.2 |
| 5,522,288 | 6/1996 | Slusar et al. | 81/63.2 |
| 5,533,427 | 7/1996 | Chow | 81/63.2 |

*Primary Examiner*—Eileen P. Morgan
*Assistant Examiner*—Joni B. Danganan
*Attorney, Agent, or Firm*—Rosenberg, Klein & Lee

[57] ABSTRACT

A ratchet wrench is provided having an arcuate toothed pawl meshing with the ratchet gear of a socket driving member. A gear section engages the back side of the pawl to control the rotation direction of the socket driving member. By the ratchet gear forcing the arcuate toothed pawl against the circular recess, a great torsion force can be transferred to the socket driving member.

1 Claim, 8 Drawing Sheets

RATCHET WRENCH HAVING GEAR DRIVEN PAWL

BACKGROUND OF THE INVENTION

1. Field of the Invention

The present invention relates to a ratchet wrench, and more particularly to a rotation direction reversing gear setting mechanism on the head of a ratchet wrench for transferring strong torsion.

2. Description of Prior Art

In accordance with a conventional ratchet wrench 8, as shown in FIG. 8, the head 82 has a housing composing two interconnected circular recesses 811 and 812. The front recess 811 of the head 81 provides a space for holding a ratchet gear 821 of a socket driving member 82 therein. Behind it, the recess 812 holds two strip pawls 831 and 832 and a button toggle 85 therein. In the space between the outside edges of the strip pawls 831 and 832 and the inside wall of the circular recess 812, two conical springs 84 are respectively arranged. The button toggle 85 is set in a proper position between the inside edges of both strip pawls 831 and 832, for controlling which of the two strip pawls 831 and 832 will engage or disengage with the ratchet gear 821. In this case, as above-described, the transfer of all of the torsion force exerted on the handle of the ratchet wrench 8, depends on the engaging tooth of the ratchet gear 821 of the socket driving member 82 and one of the catching pawls 831 or 832, for generating a torsion moment on the socket driving member 82. Since the contacting surface between the strip pawl 831, 832 and the ratchet gear 821 is so small, the stress is too concentrated, distorting or even breaking the strip pawl, and damaging the tooth of the ratchet gear 821. Due to the small contact area, the generated torsion moment is so limited that changing the material, employing a harder carbide alloy, is the only way of improving the transfer of the torsion moment. The material cost and machining cost will therefore be increased, meanwhile, the production capacity and the output coefficient will be reduced. Even so, the improved value or torsion moment is very limited.

OBJECTS AND SUMMARY OF THE INVENTION

It is therefore a main object of the present invention to provide a ratchet wrench that can be operated with a heavier torsion force than exerted on a conventional ratchet wrench, and avoid any damage to the inside components under a heavy torsion force.

For achieving that object, the present invention adopts an arcuate toothed pawl meshing with the ratchet gear to move together, and a directional shifting gear engaging the back side of the arcuate toothed pawl to reverse the rotation direction of the ratchet gear and for increasing the contact area to transfer a large torsion moment.

DETAILED DESCRIPTION OF THE PREFERRED EMBODIMENTS

Figure 1:
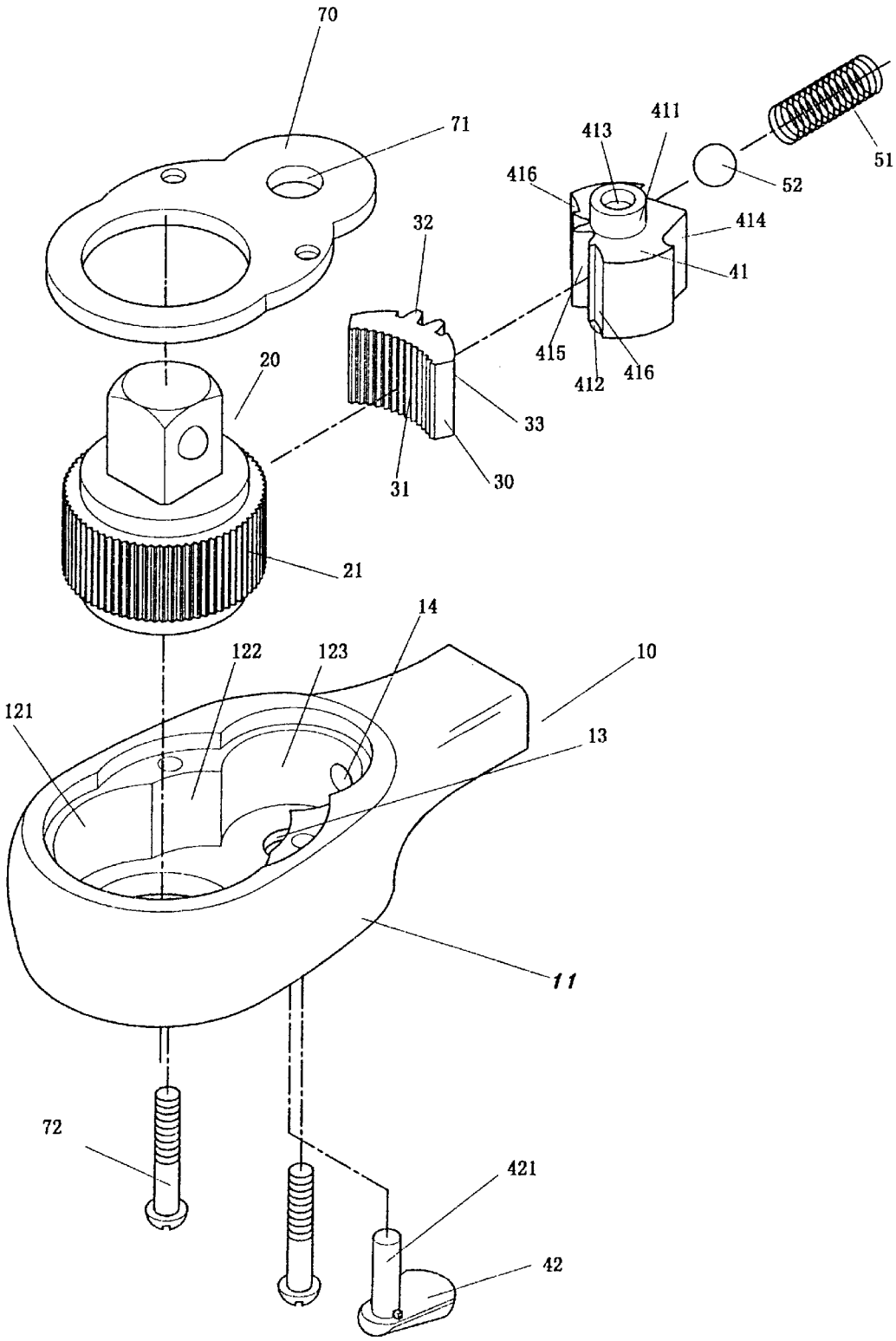
FIG. 1 is an exploded view of the present invention.
Figure 2:
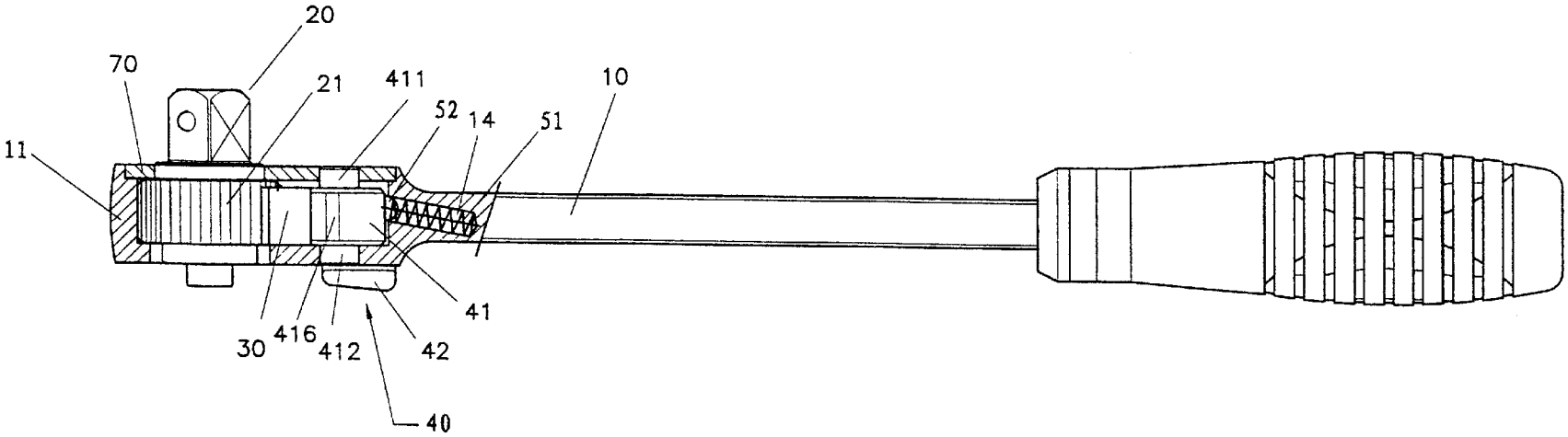
FIG. 2 is a partial cross-sectional elevation view of the present invention.

Referring to FIG. 1 and FIG. 2, a ratchet wrench 10 is shown to have a head 11 having several interconnecting circular recesses 121, 122 and 123 for containing a socket driving member 20 with a ratchet gear 21 formed thereon in the front recess 121, an arcuate toothed pawl 30 in the middle recess 122 and a directional shifting gear 40 in the rear recess 123. Co-operating with a cover plate 70 and several screws 72. All of the above-mentioned components are sealed in the head 11.

The arcuate toothed pawl 30 has a toothed segment 31 built upon the inside front face thereof and corresponding to the ratchet gear 21 of the socket driving member 20, and a gear section 32 disposed in the middle of the rear convex surface 33, which surface extends on both sides of the gear section 32.

The directional shifting gear 40 comprises a shifting block 41 and a direction toggle switch 42. The shifting block 41 has two lugs 411 and 412 formed on the top and bottom sides, respectively, for fitting into the location hole 71 of the cover plate 70 and the location hole 13 of the head 11, and a through-hole 413 extending through the centers of both lugs 411 and 412. The direction toggle switch 42 has a pin 421 extending upward therefrom to fit into the through-hole 413 of the shifting block 41 from the bottom side of the head 11 and is riveted to the shifting block 41 on the opposite side. The shifting block 41 has a V-shaped sliding surface 414 on the rear end thereof, and a gear section 415 formed in the middle segment of the front end thereof to engage with the gear section 32 of the arcuate toothed pawl 30. Curved surfaces 416 are disposed on both sides of the gear section 415.

The rearmost recess 123 has a blind hole 14 formed in the rear end wall for containing a compression spring 51 and a steel ball 52. The steel ball 52 is pushed against the sliding surface 414 of the directional shifting gear 40 by the compression spring 51, for releasably holding the shifting block 41 in different positions to control the socket driving member 20 rotation in a clockwise or counter-clockwise direction via the arcuate toothed pawl 30.

Figure 3:
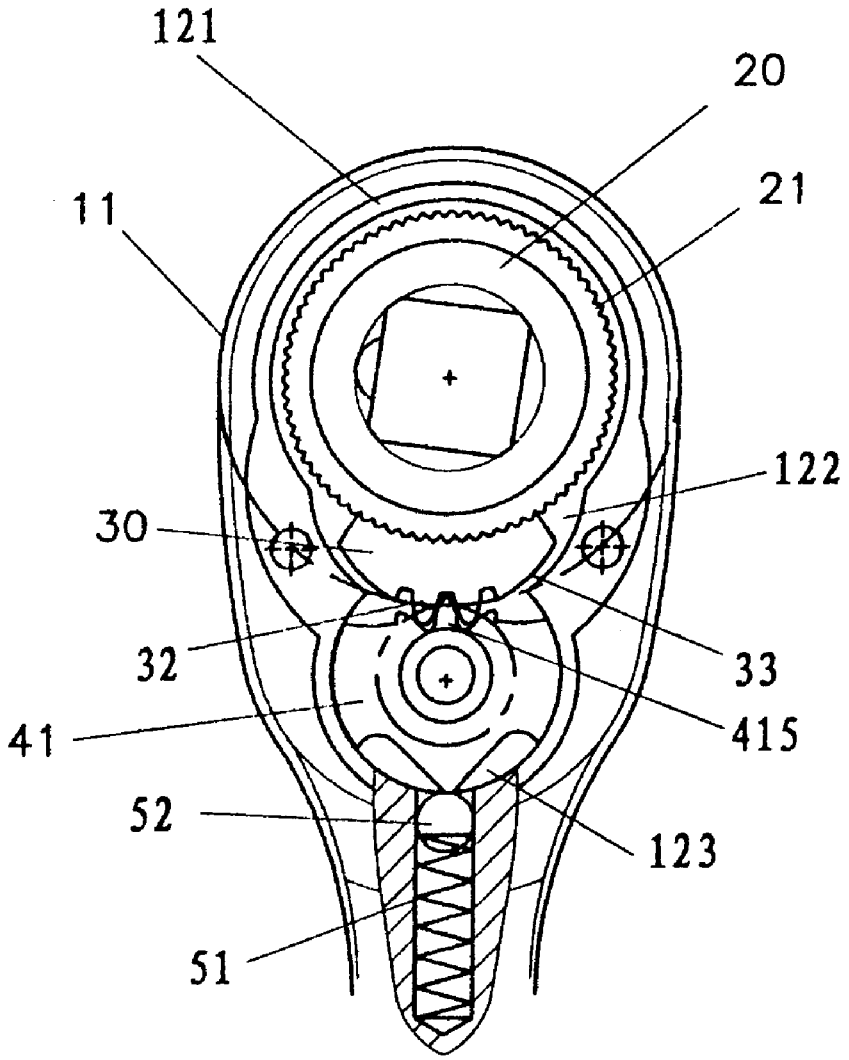
FIG. 3 is a plan view of the present invention.

Referring to FIG. 3, when the pitch circle center point of the gear section 32 of the arcuate toothed pawl 30 is in coincidence with the center point of the ratchet gear 21, both ends of the toothed segment 31 of the arcuate toothed pawl 30 engage the ratchet gear 21 and the gear section 32 engages the gear section 415 of the shifting block 41 at the same time. In that position, the arcuate toothed pawl 30 can be turned by the shifting block 41 to move to the left-side or right-side of the ratchet gear 21.

Figure 4:
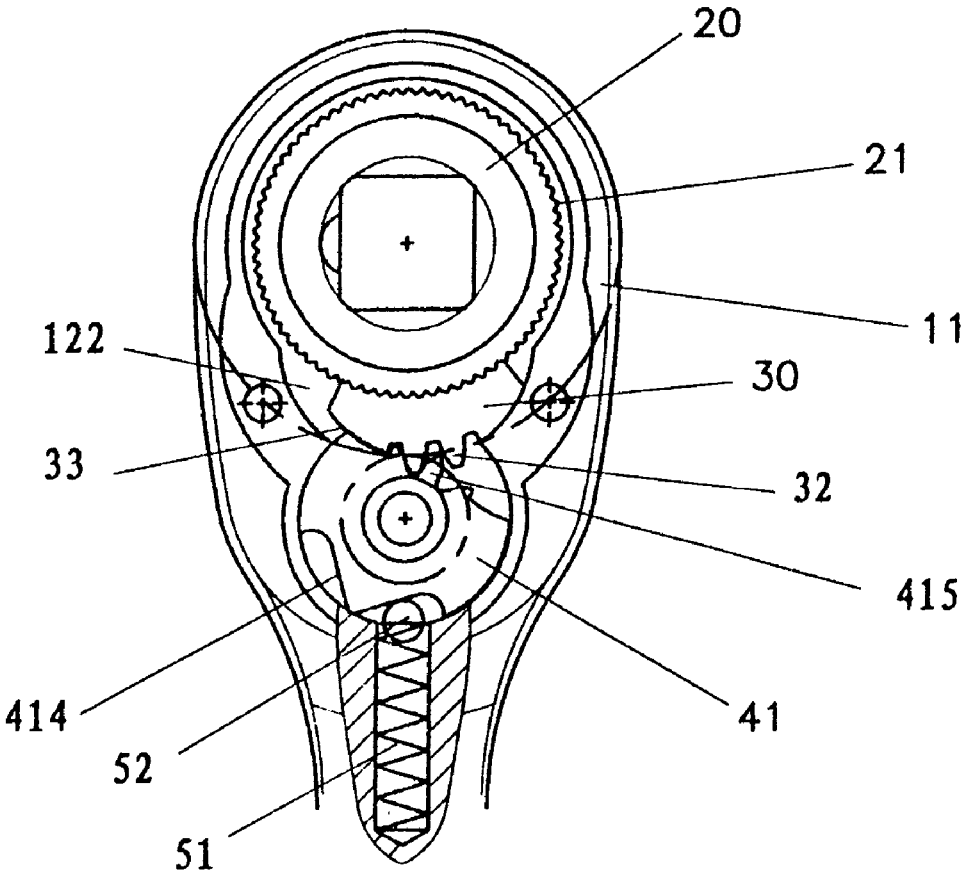
FIG. 4 and FIG. 5 are cross-sectional top-views showing shifting of the arcuate toothed pawl of the present invention.
Figure 6:
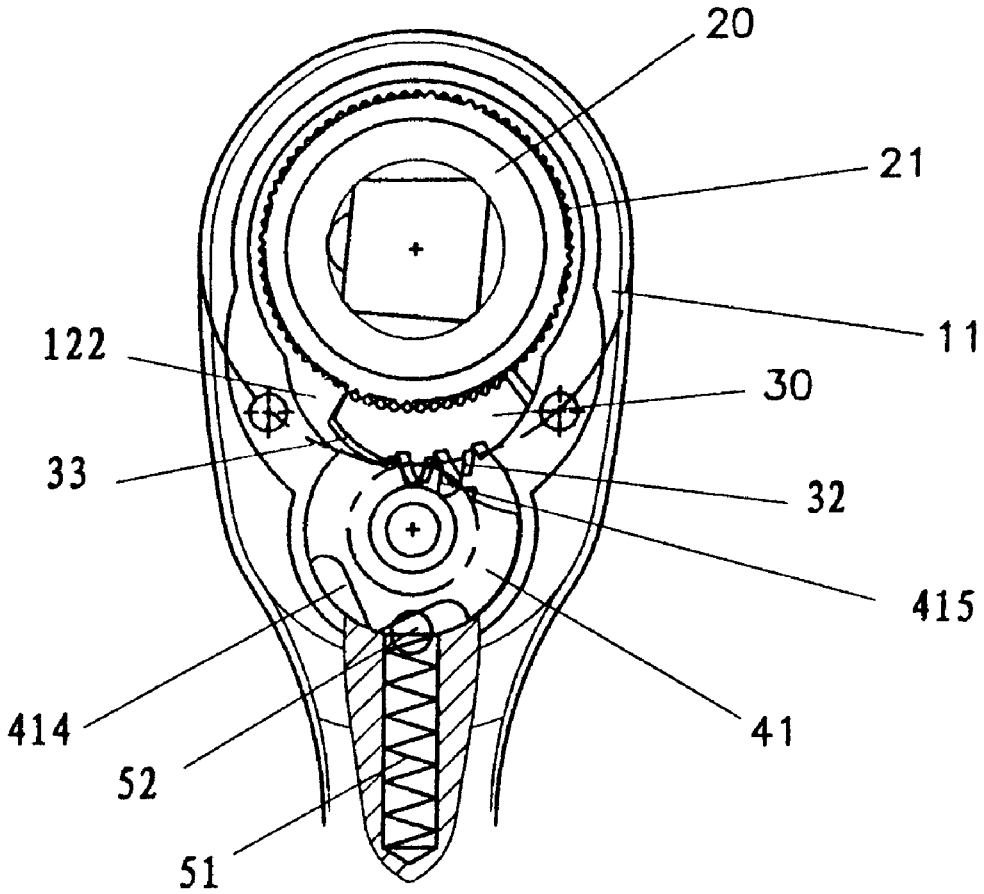
FIG. 6 is a cross-sectional top-view showing the moving of the arcuate toothed pawl of the present invention.

Referring to FIG. 4, when rotating the shifting block 41, co-operating with the compression spring 51 and the steel ball 52, the arcuate toothed pawl 30 is pushed to one side, while still being engaged with the ratchet gear 21, so that pawl 30 is held tightly against the inside wall surface of circular recess 122 of the head 11, to interlock the pawl 30 and ratchet gear 21 together. In this situation, the greater the torsion force generated by the exertion of a torsion moment, the tighter they hold together, in order to transfer a very large torsion force, if the socket driving member 20 tends to rotate counter-clockwise. When the socket driving member 20 rotates clockwise, as shown in FIG. 6, the arcuate toothed pawl 30 will be withdrawn out from the above-mentioned locking state by its displacement clockwise synchronously with the arcuate toothed pawl 20, and the shifting block 41 is angularly pivoted at the same time. But, due to the force exerted on the back end by the compression spring 51 and the steel ball 52, the shifting block 41 will hold the arcuate toothed pawl 30, keeping it in a centralized location so that the toothed segment 31 of the arcuate toothed pawl 30 disengages from the ratchet gear 21, by slipping under the restoring force of the compression spring 51. Thus, the socket driving member 20 can be locked in one direction of rotation and free to rotate in the opposite direction, as is common for conventional ratchet wrenches.

Figure 5:
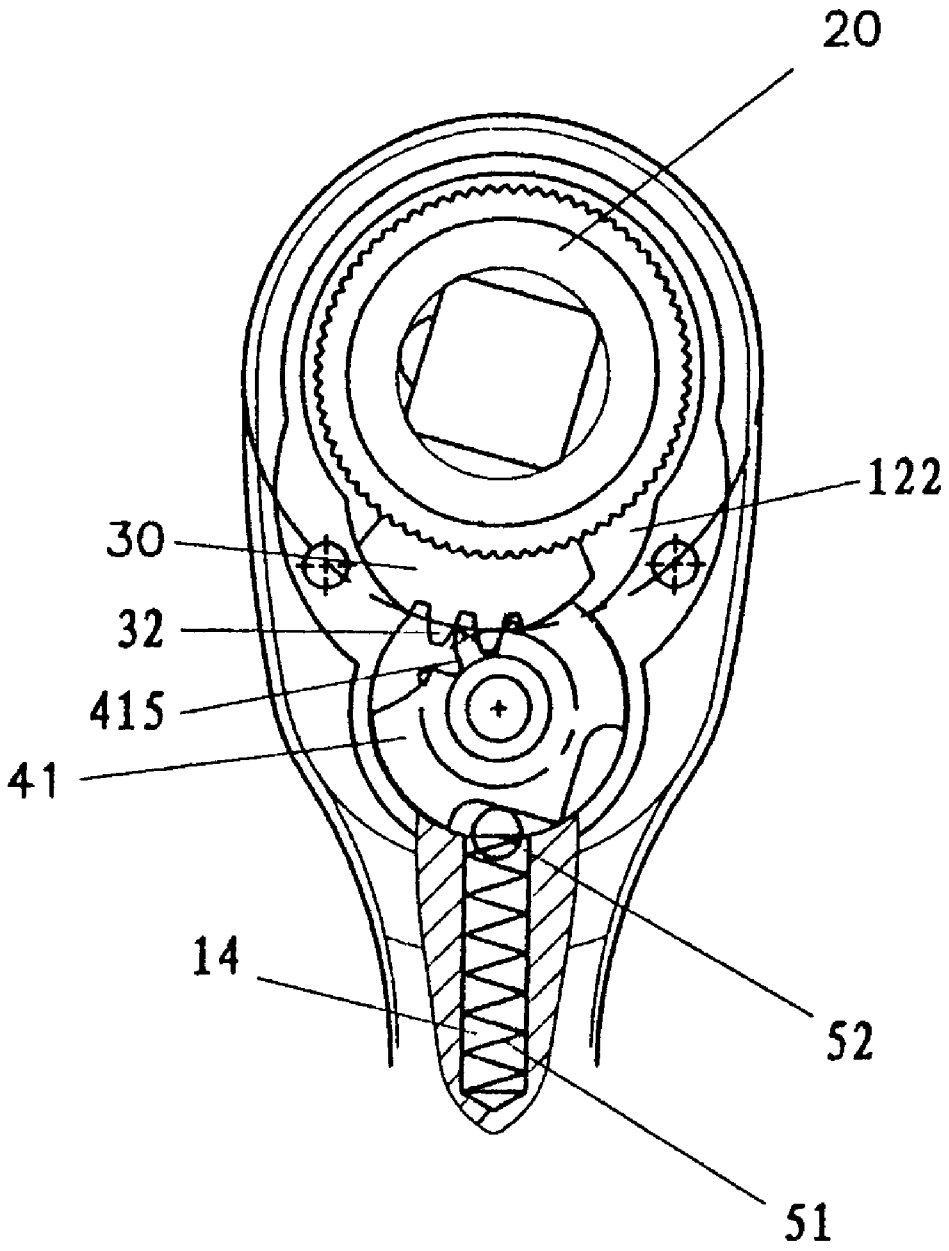

The action of the arcuate toothed pawl is as follows:

Referring to FIG. 3 to FIG. 5, the socket driving member 20 can be locked in different rotational directions by shifting the position of the shifting block 41, as shown in FIG. 4. By means of the engagement between the gear sections 415 and 32, and the rotation of ratchet gear 21, the arcuate toothed pawl 30 can be moved to the right-side of the circular recess 122 by the shifting block 41. Turning the shifting block 41 in a counter-clockwise direction displaces the pawl 30 to a mid-point, as shown in FIG. 3. If the shifting block 41 is rotated further in the counter-clockwise direction, the shifting block 41 pushes the pawl 30 to the gap on the left-side of the circular recess 122, as shown in FIG. 5. Meanwhile, the steel ball 52 slides along the V-shaped sliding surface 414 on the rear end of shifting block 41, to generate a pushing force so that the socket driving member 20 transmits a torsion moment in an opposing direction. Considering the advantages of the engaging of the gear sections 415 and 32, as above-described, the shifting block 41 can shift the pawl 30 to change the torsion force application direction of the socket driving member 20 smoothly. In the free direction, the pawl 30 disengages from ratchet gear 21, slipping against the elastic force of the spring 51.

Figure 7:
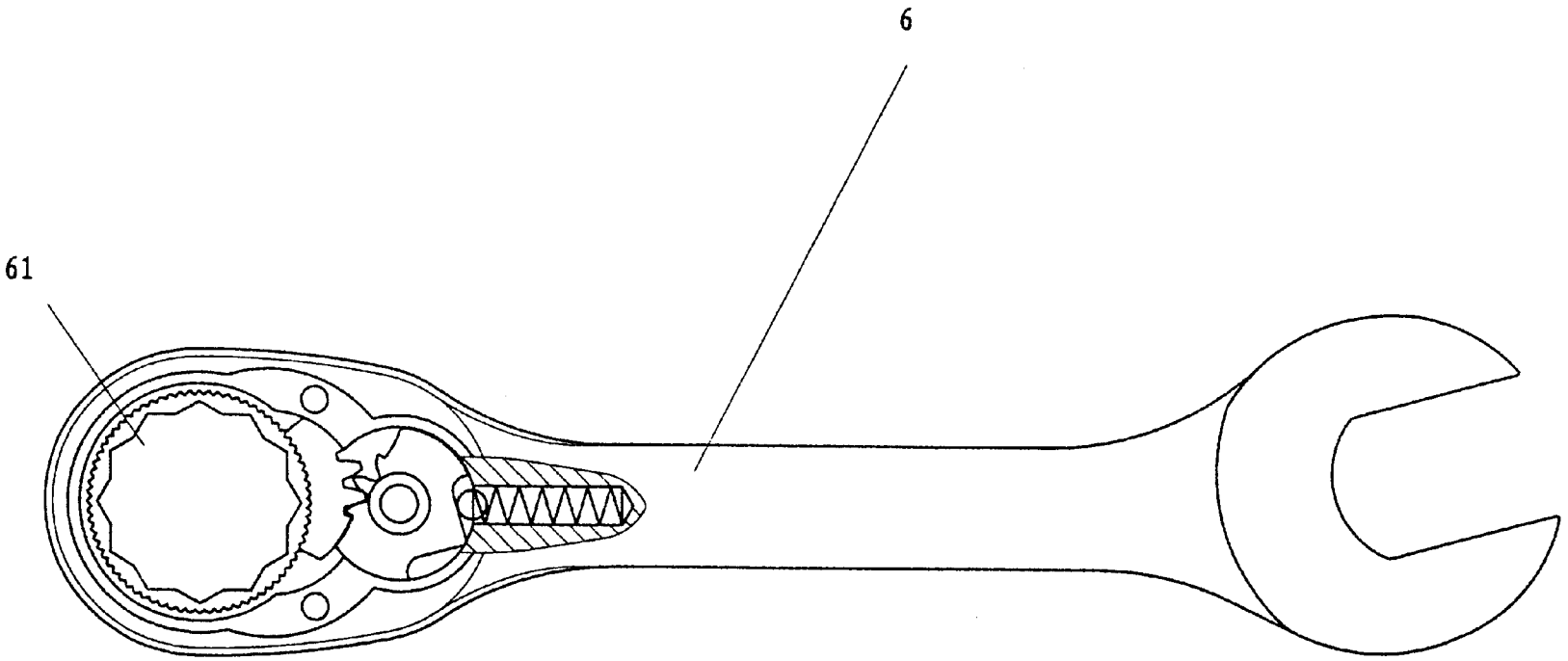
FIG. 7 is a part cross-sectional top-view showing an operation of the present invention.
Figure 8:
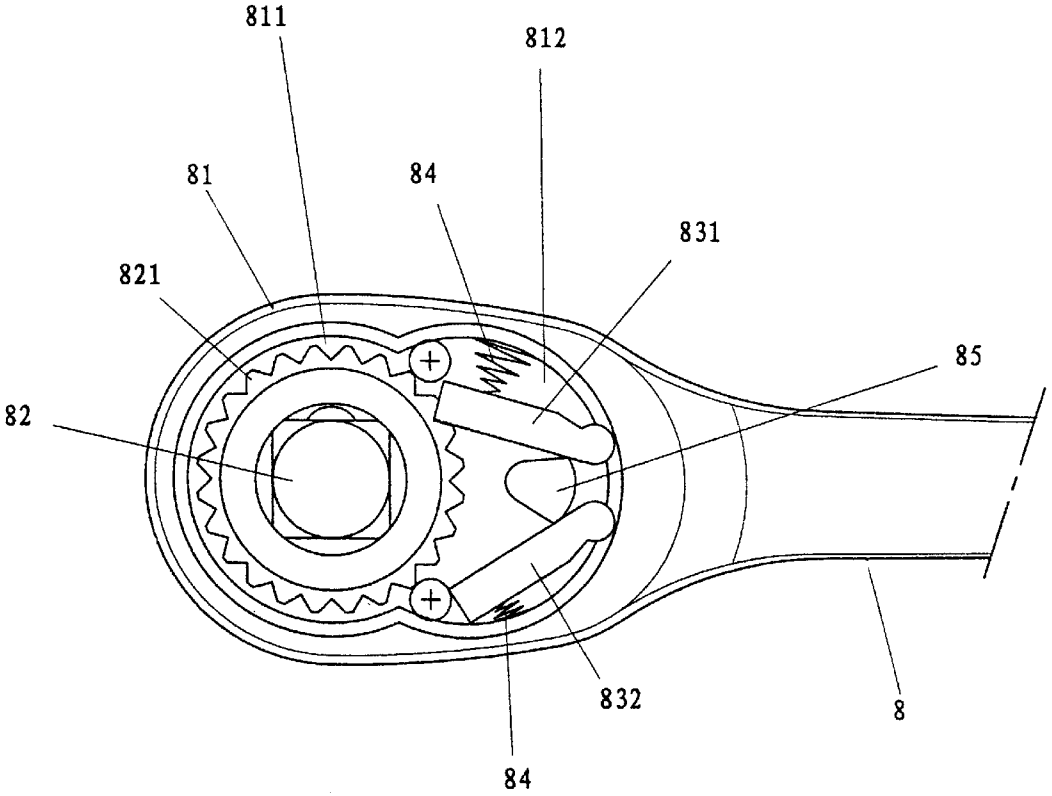
PRIOR ART FIG. 8
FIG. 8 is a cross-sectional view of the prior art.

Referring to FIG. 7, the operation of the present invention is incorporated with ring spanner head 61 on an end of a wrench 6.

I claim:

1. A ratchet wrench, comprising:

a head formed at one end of a handle, said head having three interconnecting circular recesses formed therein;

a cover plate overlaying said three circular recesses;

a socket driving member rotatably disposed within a distal-most one of said three circular recesses and having a portion thereof extending through an opening formed in said cover plate, said socket driving member having a ratchet gear formed thereon;

a shifting block pivotally coupled to said head within a proximal-most one of said three circular recesses, said shifting block having an arcuate front face with a centrally disposed first gear section formed thereon and a V-shaped sliding surface formed on an opposing rear face thereof;

a direction toggle switch coupled to said shifting block for pivotally displacing said direction block;

a spring biased ball disposed in a hole formed in a rear wall of said proximal most circular recess for maintaining contact with said V-shaped sliding surface to form a detent; and, a pawl having an arcuate contour disposed in an intermediate one of said three circular recesses, said pawl having a concave front surface with teeth formed therein meshingly engaged with said ratchet gear, said pawl having a convex rear surface complementary to said arcuate front face of said shifting block and a second gear section centrally located thereon and meshingly engaged with said first gear section, wherein pivoting said shifting block to a first position displaces said pawl to one side of said intermediate recess with a first portion of said convex surface being in contiguous contact with a wall surface of said intermediate recess and a second portion of said convex surface being in contiguous contact with a corresponding surface portion of said arcuate front face of said shifting block for preventing rotation of said socket driving member in one of two opposing rotative directions, and wherein pivoting said shifting block to a second position displaces said pawl to another side of said intermediate recess with said second portion of said convex surface being in contiguous contact with a corresponding wall surface of said intermediate recess and said first portion of said convex surface being in contiguous contact with a corresponding surface portion of said arcuate front face of said shifting block for preventing rotation of said socket driving member in the other rotative direction.

* * * * *